US008919587B2

(12) United States Patent
Howell et al.

(10) Patent No.: US 8,919,587 B2
(45) Date of Patent: Dec. 30, 2014

(54) PLASTIC CONTAINER WITH ANGULAR VACUUM PANEL AND METHOD OF SAME

(75) Inventors: Justin A. Howell, New Cumberland, PA (US); Mark O. Borger, York, PA (US); Raymond A. Pritchett, Jr., Manchester, PA (US)

(73) Assignee: Graham Packaging Company, L.P., York, PA (US)

( * ) Notice: Subject to any disclaimer, the term of this patent is extended or adjusted under 35 U.S.C. 154(b) by 331 days.

(21) Appl. No.: 13/251,966

(22) Filed: Oct. 3, 2011

(65) Prior Publication Data

US 2013/0082024 A1 Apr. 4, 2013

(51) Int. Cl.

| | |
|---|---|
| ***B65D 1/40*** | (2006.01) |
| ***B65D 79/00*** | (2006.01) |
| ***B65D 1/02*** | (2006.01) |
| *B65B 25/00* | (2006.01) |
| *B65B 3/02* | (2006.01) |

(52) U.S. Cl.

CPC ..... *B65D 79/005* (2013.01); *B65D 1/40* (2013.01); *B65D 1/0223* (2013.01); *B65D 2501/0036* (2013.01); *B65B 25/001* (2013.01); *B65B 3/02* (2013.01)

USPC ..... 215/381; 220/660; 220/666

(58) Field of Classification Search

CPC ..... B65D 1/40

USPC ..... 220/660, 666; 215/381, 383; D9/542

See application file for complete search history.

(56) References Cited

U.S. PATENT DOCUMENTS

| | | | |
|---|---|---|---|
| 1,499,239 | A | 6/1924 | Malmquist |
| D110,624 | S | 7/1938 | Mekeel, Jr. |
| 2,124,959 | A | 7/1938 | Vogel |
| 2,142,257 | A | 1/1939 | Saeta |
| 2,378,324 | A | 6/1945 | Ray et al. |
| 2,880,902 | A | 4/1959 | Owsen |
| 2,960,248 | A | 11/1960 | Kuhlman |
| 2,971,671 | A | 2/1961 | Shakman |

(Continued)

FOREIGN PATENT DOCUMENTS

| | | | |
|---|---|---|---|
| AU | 2002257159 | B2 | 4/2003 |
| CA | 2077717 | A1 | 3/1993 |

(Continued)

OTHER PUBLICATIONS

U.S. Appl. No. 13/210,350, filed Aug. 15, 2011, Wurster et al.
U.S. Appl. No. 13/210,358, filed Aug. 15, 2011, Wurster et al.
U.S. Appl. No. 13/410,902, filed Mar. 2, 2012, Gill.
U.S. Appl. No. 60/220,326, filed Jul. 24, 2000.
International Search Report for PCT/US2005/008374 dated Aug. 2, 2005.
IPRP (including Written Opinion) for PCT/US2005/008374 dated Sep. 13, 2006.

(Continued)

*Primary Examiner* — Sue A Weaver
(74) *Attorney, Agent, or Firm* — Baker Botts L.L.P.

(57) ABSTRACT

A plastic container, sidewall portions, and method of same are described. The sidewall portion can accommodate a vacuum in a filled and sealed container and includes a plurality of columns extending between upper and lower ends of the sidewall portion, and a plurality of vacuum panels oriented vertically between respective adjacent ones of the columns, each vacuum panel including an upper section, a middle section, and a lower section, a first hinge connecting the upper and middle sections, and a second hinge connecting the middle and lower sections. The vacuum panels can move radially inward toward a container central axis such that the container vacuum is accommodated. As the vacuum panel moves radially inward, the middle section can maintain a substantially parallel orientation with respect to the central axis, and the upper and lower sections rotate about first and second hinges, respectively, and incline away from the central axis.

10 Claims, 10 Drawing Sheets

(56) References Cited

U.S. PATENT DOCUMENTS 2,982,440 A 5/1961 Harrison
3,043,461 A 7/1962 Glassco
3,081,002 A 3/1963 Tauschinski et al.
3,090,478 A 5/1963 Stanley
3,142,371 A 7/1964 Rice et al.
3,174,655 A 3/1965 Hurschman
3,198,861 A 8/1965 Marvel
3,201,111 A 8/1965 Afton
3,301,293 A 1/1967 Santelli
3,325,031 A 6/1967 Singier
3,397,724 A 8/1968 Bolen et al.
3,409,167 A 11/1968 Blanchard
3,417,893 A 12/1968 Lieberman
3,426,939 A 2/1969 Young
3,441,982 A 5/1969 Tsukahara et al.
3,468,443 A 9/1969 Marcus
3,483,908 A 12/1969 Donovan
3,485,355 A 12/1969 Stewart
3,693,828 A 9/1972 Kneusel et al.
3,704,140 A 11/1972 Petit et al.
3,727,783 A 4/1973 Carmichael
3,791,508 A 2/1974 Osborne et al.
3,819,789 A 6/1974 Parker
3,904,069 A 9/1975 Toukmanian
3,918,920 A 11/1975 Barber
3,935,955 A 2/1976 Das
3,941,237 A 3/1976 MacGregor, Jr.
3,942,673 A 3/1976 Lyu et al.
3,949,033 A 4/1976 Uhlig
3,956,441 A 5/1976 Uhlig
4,035,455 A 7/1977 Rosenkranz et al.
4,036,926 A 7/1977 Chang
4,037,752 A 7/1977 Dulmaine et al.
4,117,062 A 9/1978 Uhlig
4,123,217 A 10/1978 Fischer et al.
4,125,632 A 11/1978 Vosti et al.
4,134,510 A 1/1979 Chang
4,158,624 A 6/1979 Ford et al.
4,170,622 A 10/1979 Uhlig
4,174,782 A 11/1979 Obsomer
4,177,239 A 12/1979 Gittner et al.
4,219,137 A 8/1980 Hutchens
4,231,483 A 11/1980 Dechenne et al.
4,247,012 A 1/1981 Alberghini
4,301,933 A 11/1981 Yoshino et al.
4,318,489 A 3/1982 Snyder et al.
4,318,882 A 3/1982 Agrawal et al.
4,338,765 A 7/1982 Ohmori et al.
4,355,728 A 10/1982 Ota et al.
4,377,191 A 3/1983 Yamaguchi
4,378,328 A 3/1983 Przytulla et al.
4,381,061 A 4/1983 Cerny et al.
D269,158 S 5/1983 Gaunt et al.
4,386,701 A 6/1983 Galer
4,436,216 A 3/1984 Chang
4,444,308 A 4/1984 MacEwen
4,450,878 A 5/1984 Takada et al.
4,465,199 A 8/1984 Aoki
4,495,974 A 1/1985 Pohorski
4,497,621 A 2/1985 Kudert et al.
4,497,855 A 2/1985 Agrawal et al.
4,525,401 A 6/1985 Pocock et al.
4,542,029 A 9/1985 Caner et al.
4,547,333 A 10/1985 Takada
4,585,158 A 4/1986 Wardlaw, III
4,610,366 A 9/1986 Estes et al.
4,628,669 A 12/1986 Herron et al.
4,642,968 A 2/1987 McHenry et al.
4,645,078 A 2/1987 Reyner
4,667,454 A 5/1987 McHenry et al.
4,684,025 A 8/1987 Copland et al.
4,685,273 A 8/1987 Caner et al.
D292,378 S 10/1987 Brandt et al.
4,701,121 A 10/1987 Jakobsen et al.
4,723,661 A 2/1988 Hoppmann et al.
4,724,855 A 2/1988 Jackson
4,725,464 A 2/1988 Collette
4,747,507 A 5/1988 Fitzgerald et al.
4,749,092 A 6/1988 Sugiura et al.
4,769,206 A 9/1988 Reymann et al.
4,773,458 A 9/1988 Touzani
4,785,949 A 11/1988 Krishnakumar et al.
4,785,950 A 11/1988 Miller et al.
4,807,424 A 2/1989 Robinson et al.
4,813,556 A 3/1989 Lawrence
4,831,050 A 5/1989 Cassidy et al.
4,836,398 A 6/1989 Leftault, Jr. et al.
4,840,289 A 6/1989 Fait et al.
4,850,493 A 7/1989 Howard, Jr.
4,850,494 A 7/1989 Howard, Jr.
4,865,206 A 9/1989 Behm et al.
4,867,323 A 9/1989 Powers
4,880,129 A 11/1989 McHenry et al.
4,887,730 A 12/1989 Touzani
4,892,205 A 1/1990 Powers et al.
4,896,205 A 1/1990 Weber
4,921,147 A 5/1990 Poirier
4,927,679 A 5/1990 Beck
4,962,863 A 10/1990 Wendling et al.
4,967,538 A 11/1990 Leftault, Jr. et al.
4,978,015 A 12/1990 Walker
4,997,692 A 3/1991 Yoshino
5,004,109 A 4/1991 Bartley et al.
5,005,716 A 4/1991 Eberle
5,014,868 A 5/1991 Wittig et al.
5,020,691 A 6/1991 Nye
5,024,340 A 6/1991 Alberghini et al.
5,033,254 A 7/1991 Zenger
5,054,632 A 10/1991 Alberghini et al.
5,060,453 A 10/1991 Alberghini et al.
5,064,081 A * 11/1991 Hayashi et al. ..... 215/373
5,067,622 A 11/1991 Garver et al.
5,090,180 A 2/1992 Sorensen
5,092,474 A 3/1992 Leigner
5,122,327 A 6/1992 Spina et al.
5,133,468 A 7/1992 Brunson et al.
5,141,121 A 8/1992 Brown et al.
5,178,290 A 1/1993 Ota et al.
5,199,587 A 4/1993 Ota et al.
5,199,588 A 4/1993 Hayashi
5,201,438 A 4/1993 Norwood
5,217,737 A 6/1993 Gygax et al.
5,234,126 A 8/1993 Jonas et al.
5,244,106 A 9/1993 Takacs
5,251,424 A 10/1993 Zenger et al.
5,255,889 A 10/1993 Collette et al.
5,261,544 A 11/1993 Weaver, Jr.
5,279,433 A 1/1994 Krishnakumar et al.
5,281,387 A 1/1994 Collette et al.
5,310,043 A 5/1994 Alcorn
5,333,761 A 8/1994 Davis et al.
5,337,909 A 8/1994 Vailliencourt
5,337,924 A 8/1994 Dickie
5,341,946 A 8/1994 Vailliencourt et al.
5,389,332 A 2/1995 Amari et al.
5,392,937 A 2/1995 Prevot et al.
5,405,015 A 4/1995 Bhatia et al.
5,407,086 A 4/1995 Ota et al.
5,411,699 A 5/1995 Collette et al.
5,454,481 A 10/1995 Hsu
5,472,105 A 12/1995 Krishnakumar et al.
5,472,181 A 12/1995 Lowell
RE35,140 E 1/1996 Powers, Jr.
5,484,052 A 1/1996 Pawloski et al.
D366,831 S 2/1996 Semersky et al.
5,492,245 A 2/1996 Kalbanis
5,503,283 A 4/1996 Semersky
5,543,107 A 8/1996 Malik et al.
5,593,063 A 1/1997 Claydon et al.
5,598,941 A 2/1997 Semersky et al.
5,632,397 A 5/1997 Fandeux et al.
5,642,826 A 7/1997 Melrose
5,672,730 A 9/1997 Cottman
5,687,874 A 11/1997 Omori et al.

(56) References Cited

U.S. PATENT DOCUMENTS

| | | | |
|---|---|---|---|
| 5,690,244 | A | 11/1997 | Darr |
| 5,697,489 | A | 12/1997 | Deonarine et al. |
| 5,704,504 | A | 1/1998 | Bueno |
| 5,713,480 | A | 2/1998 | Petre et al. |
| 5,718,030 | A | 2/1998 | Langmack et al. |
| 5,730,314 | A | 3/1998 | Wiemann et al. |
| 5,730,914 | A | 3/1998 | Ruppmann, Sr. |
| 5,735,420 | A | 4/1998 | Nakamaki et al. |
| 5,737,827 | A | 4/1998 | Kuse et al. |
| 5,758,802 | A | 6/1998 | Wallays |
| 5,762,221 | A | 6/1998 | Tobias et al. |
| 5,780,130 | A | 7/1998 | Hansen et al. |
| 5,785,197 | A | 7/1998 | Slat |
| 5,819,507 | A | 10/1998 | Kaneko et al. |
| 5,829,614 | A | 11/1998 | Collette et al. |
| 5,860,556 | A | 1/1999 | Robbins, III |
| 5,887,739 | A | 3/1999 | Prevot et al. |
| 5,888,598 | A | 3/1999 | Brewster et al. |
| 5,897,090 | A | 4/1999 | Smith et al. |
| 5,906,286 | A | 5/1999 | Matsuno et al. |
| 5,908,128 | A | 6/1999 | Krishnakumar et al. |
| D413,519 | S | 9/1999 | Eberle et al. |
| D415,030 | S | 10/1999 | Searle et al. |
| 5,971,184 | A | 10/1999 | Krishnakumar et al. |
| 5,976,653 | A | 11/1999 | Collette et al. |
| 5,989,661 | A | 11/1999 | Krishnakumar et al. |
| 6,016,932 | A | 1/2000 | Gaydosh et al. |
| RE36,639 | E | 4/2000 | Okhai |
| 6,045,001 | A | 4/2000 | Seul |
| 6,051,295 | A | 4/2000 | Schloss et al. |
| 6,063,325 | A | 5/2000 | Nahill et al. |
| 6,065,624 | A | 5/2000 | Steinke |
| 6,068,110 | A | 5/2000 | Kumakiri et al. |
| 6,074,596 | A | 6/2000 | Jacquet |
| 6,077,554 | A | 6/2000 | Wiemann et al. |
| 6,090,334 | A | 7/2000 | Matsuno et al. |
| 6,105,815 | A | 8/2000 | Mazda |
| 6,113,377 | A | 9/2000 | Clark |
| D433,946 | S | 11/2000 | Rollend et al. |
| 6,176,382 | B1 | 1/2001 | Bazlur Rashid |
| D440,877 | S | 4/2001 | Lichtman et al. |
| 6,209,710 | B1 | 4/2001 | Mueller et al. |
| 6,213,325 | B1 | 4/2001 | Cheng et al. |
| 6,217,818 | B1 | 4/2001 | Collette et al. |
| 6,228,317 | B1 | 5/2001 | Smith et al. |
| 6,230,912 | B1 | 5/2001 | Rashid |
| 6,248,413 | B1 | 6/2001 | Barel et al. |
| 6,253,809 | B1 | 7/2001 | Paradies |
| 6,273,282 | B1 | 8/2001 | Ogg et al. |
| 6,277,321 | B1 | 8/2001 | Vailliencourt et al. |
| 6,298,638 | B1 | 10/2001 | Bettle |
| D450,595 | S | 11/2001 | Ogg et al. |
| 6,354,427 | B1 | 3/2002 | Pickel et al. |
| 6,375,025 | B1 | 4/2002 | Mooney |
| 6,390,316 | B1 | 5/2002 | Mooney |
| 6,413,466 | B1 | 7/2002 | Boyd et al. |
| 6,439,413 | B1 | 8/2002 | Prevot et al. |
| 6,460,714 | B1 | 10/2002 | Silvers et al. |
| 6,467,639 | B2 | 10/2002 | Mooney |
| 6,485,669 | B1 | 11/2002 | Boyd et al. |
| 6,494,333 | B2 | 12/2002 | Sasaki et al. |
| 6,502,369 | B1 | 1/2003 | Andison et al. |
| 6,514,451 | B1 | 2/2003 | Boyd et al. |
| 6,585,123 | B1 | 7/2003 | Pedmo et al. |
| 6,585,124 | B2 | 7/2003 | Boyd et al. |
| 6,595,380 | B2 | 7/2003 | Silvers |
| 6,612,451 | B2 | 9/2003 | Tobias et al. |
| 6,635,217 | B1 | 10/2003 | Britton |
| D482,976 | S | 12/2003 | Melrose |
| 6,662,960 | B2 | 12/2003 | Hong et al. |
| 6,676,883 | B2 | 1/2004 | Hutchinson et al. |
| D492,201 | S | 6/2004 | Pritchett et al. |
| 6,749,075 | B2 | 6/2004 | Bourque et al. |
| 6,749,780 | B2 | 6/2004 | Tobias |
| 6,763,968 | B1 | 7/2004 | Boyd et al. |
| 6,763,969 | B1 | 7/2004 | Melrose et al. |
| 6,769,561 | B2 | 8/2004 | Futral et al. |
| 6,779,673 | B2 | 8/2004 | Melrose et al. |
| 6,796,450 | B2 | 9/2004 | Prevot et al. |
| 6,920,992 | B2 | 7/2005 | Lane et al. |
| 6,923,334 | B2 | 8/2005 | Melrose et al. |
| 6,929,138 | B2 | 8/2005 | Melrose et al. |
| 6,932,230 | B2 | 8/2005 | Pedmo et al. |
| 6,942,116 | B2 | 9/2005 | Lisch et al. |
| 6,974,047 | B2 | 12/2005 | Kelley et al. |
| 6,983,858 | B2 | 1/2006 | Slat et al. |
| 7,051,073 | B1 | 5/2006 | Dutta |
| 7,051,889 | B2 | 5/2006 | Boukobza |
| D522,368 | S | 6/2006 | Darr et al. |
| 7,073,675 | B2 | 7/2006 | Trude |
| 7,077,279 | B2 | 7/2006 | Melrose |
| 7,080,747 | B2 | 7/2006 | Lane et al. |
| D531,910 | S | 11/2006 | Melrose |
| 7,137,520 | B1 | 11/2006 | Melrose |
| 7,140,505 | B2 | 11/2006 | Roubal et al. |
| 7,150,372 | B2 | 12/2006 | Lisch et al. |
| D535,884 | S | 1/2007 | Davis et al. |
| 7,159,374 | B2 | 1/2007 | Abercrombie, III et al. |
| D538,168 | S | 3/2007 | Davis et al. |
| D547,664 | S | 7/2007 | Davis et al. |
| 7,334,695 | B2 | 2/2008 | Bysick et al. |
| 7,350,657 | B2 | 4/2008 | Eaton et al. |
| D572,599 | S | 7/2008 | Melrose |
| 7,416,089 | B2 | 8/2008 | Kraft et al. |
| D576,041 | S | 9/2008 | Melrose et al. |
| 7,451,886 | B2 | 11/2008 | Lisch et al. |
| 7,543,713 | B2 | 6/2009 | Trude et al. |
| 7,552,834 | B2 | 6/2009 | Tanaka et al. |
| 7,574,846 | B2 | 8/2009 | Sheets et al. |
| 7,694,842 | B2 | 4/2010 | Melrose |
| 7,726,106 | B2 | 6/2010 | Kelley et al. |
| 7,735,304 | B2 | 6/2010 | Kelley et al. |
| 7,748,551 | B2 | 7/2010 | Gatewood et al. |
| D623,952 | S | 9/2010 | Yourist et al. |
| 7,799,264 | B2 | 9/2010 | Trude |
| 7,882,971 | B2 | 2/2011 | Kelley et al. |
| 7,900,425 | B2 | 3/2011 | Bysick et al. |
| 7,926,243 | B2 | 4/2011 | Kelley et al. |
| D637,495 | S | 5/2011 | Gill et al. |
| D637,913 | S | 5/2011 | Schlies et al. |
| D641,244 | S | 7/2011 | Bysick et al. |
| 7,980,404 | B2 | 7/2011 | Trude et al. |
| 8,011,166 | B2 | 9/2011 | Sheets et al. |
| 8,017,065 | B2 | 9/2011 | Trude et al. |
| D646,966 | S | 10/2011 | Gill et al. |
| 8,028,498 | B2 | 10/2011 | Melrose |
| 8,075,833 | B2 | 12/2011 | Kelley |
| D653,119 | S | 1/2012 | Hunter et al. |
| 8,096,098 | B2 | 1/2012 | Kelley et al. |
| D653,550 | S | 2/2012 | Hunter |
| D653,957 | S | 2/2012 | Yourist et al. |
| 8,162,655 | B2 | 4/2012 | Trude et al. |
| 8,171,701 | B2 | 5/2012 | Kelley et al. |
| 8,235,704 | B2 | 8/2012 | Kelley |
| 8,323,555 | B2 | 12/2012 | Trude et al. |
| 2001/0035391 | A1 | 11/2001 | Young et al. |
| 2002/0063105 | A1 | 5/2002 | Darr et al. |
| 2002/0074336 | A1 | 6/2002 | Silvers |
| 2002/0096486 | A1 | 7/2002 | Bourquet et al. |
| 2002/0153343 | A1 | 10/2002 | Tobias et al. |
| 2002/0158038 | A1 | 10/2002 | Heisel et al. |
| 2003/0015491 | A1 | 1/2003 | Melrose et al. |
| 2003/0186006 | A1 | 10/2003 | Schmidt et al. |
| 2003/0196926 | A1 | 10/2003 | Tobias et al. |
| 2003/0205550 | A1 | 11/2003 | Prevot et al. |
| 2003/0217947 | A1 | 11/2003 | Ishikata et al. |
| 2004/0000533 | A1 | 1/2004 | Kamineni et al. |
| 2004/0016716 | A1 | 1/2004 | Melrose et al. |
| 2004/0074864 | A1 | 4/2004 | Melrose et al. |
| 2004/0129669 | A1 | 7/2004 | Kelley et al. |
| 2004/0149677 | A1 | 8/2004 | Slat et al. |
| 2004/0173565 | A1 | 9/2004 | Semersky et al. |
| 2004/0211746 | A1 | 10/2004 | Trude |
| 2004/0232103 | A1 | 11/2004 | Lisch et al. |

(56) References Cited

U.S. PATENT DOCUMENTS

| | | | |
|---|---|---|---|
| 2005/0035083 | A1 | 2/2005 | Pedmo et al. |
| 2005/0211662 | A1 | 9/2005 | Eaton et al. |
| 2005/0218108 | A1 | 10/2005 | Bangi et al. |
| 2005/0247664 | A1* | 11/2005 | Lane et al. ..... 215/381 |
| 2006/0006133 | A1 | 1/2006 | Lisch et al. |
| 2006/0051541 | A1 | 3/2006 | Steele |
| 2006/0138074 | A1 | 6/2006 | Melrose |
| 2006/0147664 | A1 | 7/2006 | Richards et al. |
| 2006/0151425 | A1 | 7/2006 | Kelley et al. |
| 2006/0231985 | A1 | 10/2006 | Kelley |
| 2006/0243698 | A1 | 11/2006 | Melrose |
| 2006/0255005 | A1 | 11/2006 | Melrose et al. |
| 2006/0261031 | A1 | 11/2006 | Melrose |
| 2007/0017892 | A1 | 1/2007 | Melrose |
| 2007/0045222 | A1 | 3/2007 | Denner et al. |
| 2007/0045312 | A1 | 3/2007 | Abercrombie, III et al. |
| 2007/0051073 | A1 | 3/2007 | Kelley et al. |
| 2007/0084821 | A1 | 4/2007 | Bysick et al. |
| 2007/0125742 | A1 | 6/2007 | Simpson, Jr. et al. |
| 2007/0125743 | A1 | 6/2007 | Pritchett, Jr. et al. |
| 2007/0131644 | A1 | 6/2007 | Melrose |
| 2007/0181403 | A1 | 8/2007 | Sheets et al. |
| 2007/0199915 | A1 | 8/2007 | Denner et al. |
| 2007/0199916 | A1 | 8/2007 | Denner et al. |
| 2007/0215571 | A1 | 9/2007 | Trude |
| 2007/0235905 | A1 | 10/2007 | Trude et al. |
| 2008/0029475 | A1 | 2/2008 | Scarola |
| 2008/0047964 | A1 | 2/2008 | Denner et al. |
| 2008/0156847 | A1 | 7/2008 | Hawk et al. |
| 2008/0257856 | A1 | 10/2008 | Melrose et al. |
| 2009/0090728 | A1 | 4/2009 | Trude et al. |
| 2009/0091067 | A1 | 4/2009 | Trude et al. |
| 2009/0092720 | A1 | 4/2009 | Trude et al. |
| 2009/0120530 | A1 | 5/2009 | Kelley et al. |
| 2009/0134117 | A1 | 5/2009 | Mooney |
| 2009/0202766 | A1 | 8/2009 | Beuerle et al. |
| 2009/0293436 | A1 | 12/2009 | Miyazaki et al. |
| 2010/0018838 | A1 | 1/2010 | Kelley et al. |
| 2010/0116778 | A1 | 5/2010 | Melrose |
| 2010/0133228 | A1 | 6/2010 | Trude |
| 2010/0163513 | A1 | 7/2010 | Pedmo |
| 2010/0170199 | A1 | 7/2010 | Kelley et al. |
| 2010/0213204 | A1 | 8/2010 | Melrose |
| 2010/0237083 | A1 | 9/2010 | Trude et al. |
| 2010/0301058 | A1 | 12/2010 | Trude et al. |
| 2011/0049083 | A1 | 3/2011 | Scott et al. |
| 2011/0049084 | A1 | 3/2011 | Yourist et al. |
| 2011/0084046 | A1 | 4/2011 | Schlies et al. |
| 2011/0094618 | A1 | 4/2011 | Melrose |
| 2011/0108515 | A1 | 5/2011 | Gill et al. |
| 2011/0113731 | A1 | 5/2011 | Bysick et al. |
| 2011/0132865 | A1 | 6/2011 | Hunter et al. |
| 2011/0147392 | A1 | 6/2011 | Trude et al. |
| 2011/0210133 | A1 | 9/2011 | Melrose et al. |
| 2011/0266293 | A1 | 11/2011 | Kelley et al. |
| 2011/0284493 | A1 | 11/2011 | Yourist et al. |
| 2012/0104010 | A1 | 5/2012 | Kelley |
| 2012/0107541 | A1 | 5/2012 | Nahill et al. |
| 2012/0132611 | A1 | 5/2012 | Trude et al. |
| 2012/0152964 | A1 | 6/2012 | Kelley et al. |
| 2012/0240515 | A1 | 9/2012 | Kelley et al. |
| 2012/0266565 | A1 | 10/2012 | Trude et al. |
| 2012/0267381 | A1 | 10/2012 | Trude et al. |
| 2013/0000259 | A1 | 1/2013 | Trude et al. |

FOREIGN PATENT DOCUMENTS

| | | | |
|---|---|---|---|
| DE | 1761753 | | 1/1972 |
| DE | P2102319.8 | | 8/1972 |
| DE | 3215866 | A1 | 11/1983 |
| EP | 225 155 | A2 | 6/1987 |
| EP | 225155 | A2 | 6/1987 |
| EP | 346518 | A1 | 12/1989 |
| EP | 0 502 391 | A2 | 9/1992 |
| EP | 0 505054 | A1 | 9/1992 |
| EP | 0521642 | A1 | 1/1993 |
| EP | 0 551 788 | A1 | 7/1993 |
| EP | 0666222 | A1 | 2/1994 |
| EP | 0 739 703 | | 10/1996 |
| EP | 0 609 348 | B1 | 2/1997 |
| EP | 0916406 | A2 | 5/1999 |
| EP | 0957030 | A2 | 11/1999 |
| EP | 1 063 076 | A1 | 12/2000 |
| FR | 1571499 | | 6/1969 |
| FR | 2607109 | | 5/1988 |
| GB | 781103 | | 8/1957 |
| GB | 1113988 | | 5/1968 |
| GB | 2050919 | A | 1/1981 |
| GB | 2372977 | A | 9/2002 |
| JP | S40-15909 | | 6/1940 |
| JP | 48-31050 | | 9/1973 |
| JP | 49-28628 | | 7/1974 |
| JP | 54-72181 | A | 6/1979 |
| JP | S54-70185 | | 6/1979 |
| JP | 35656830 | A | 5/1981 |
| JP | S56-62911 | | 5/1981 |
| JP | 56-72730 | U | 6/1981 |
| JP | 57-210829 | A | 1/1982 |
| JP | S57-17730 | | 1/1982 |
| JP | 57-37827 | | 2/1982 |
| JP | 57-37827 | U | 2/1982 |
| JP | 57-126310 | | 8/1982 |
| JP | 58-055005 | | 4/1983 |
| JP | 61-192539 | A | 8/1986 |
| JP | 63-189224 | A | 8/1988 |
| JP | 64-004662 | | 2/1989 |
| JP | 3-43342 | | 2/1991 |
| JP | 3-43342 | A | 2/1991 |
| JP | 03-076625 | | 4/1991 |
| JP | 4-10012 | | 1/1992 |
| JP | 5-193694 | | 8/1993 |
| JP | 53-10239 | A | 11/1993 |
| JP | H05-81009 | | 11/1993 |
| JP | 06-270235 | A | 9/1994 |
| JP | 6-336238 | A | 12/1994 |
| JP | 07-300121 | A | 11/1995 |
| JP | H08-048322 | | 2/1996 |
| JP | 08-244747 | A | 9/1996 |
| JP | 8-253220 | A | 10/1996 |
| JP | 8-282633 | A | 10/1996 |
| JP | 9-110045 | A | 4/1997 |
| JP | 09-039934 | A | 10/1997 |
| JP | 10-167226 | A | 6/1998 |
| JP | 10-181734 | A | 7/1998 |
| JP | 10-230919 | A | 9/1998 |
| JP | 3056271 | | 11/1998 |
| JP | 11-218537 | A | 8/1999 |
| JP | 2000-229615 | A | 8/2000 |
| JP | 2002-127237 | A | 5/2002 |
| JP | 2002-160717 | A | 6/2002 |
| JP | 2002-326618 | A | 11/2002 |
| JP | 2003-095238 | | 4/2003 |
| JP | 2004-026307 | A | 1/2004 |
| JP | 2006-501109 | | 1/2006 |
| JP | 2007-216981 | A | 8/2007 |
| JP | 2008-189721 | A | 8/2008 |
| JP | 2009-001639 | A | 1/2009 |
| NZ | 240448 | | 6/1995 |
| NZ | 296014 | | 10/1998 |
| NZ | 335565 | | 10/1999 |
| NZ | 506684 | | 9/2001 |
| NZ | 512423 | | 9/2001 |
| NZ | 521694 | | 10/2003 |
| WO | WO 93/09031 | A1 | 5/1993 |
| WO | WO 93/12975 | A1 | 7/1993 |
| WO | WO 94/05555 | | 3/1994 |
| WO | WO 94/06617 | | 3/1994 |
| WO | WO 97/03885 | | 2/1997 |
| WO | WO 97/14617 | | 4/1997 |
| WO | WO 97/34808 | | 9/1997 |
| WO | WO 97/34808 | A1 | 9/1997 |
| WO | WO 99/21770 | | 5/1999 |
| WO | WO 00/38902 | A1 | 7/2000 |

(56) References Cited

FOREIGN PATENT DOCUMENTS

| | | | |
|---|---|---|---|
| WO | WO 00/51895 | A1 | 9/2000 |
| WO | WO 01/12531 | A1 | 2/2001 |
| WO | WO 01/40081 | A1 | 6/2001 |
| WO | WO 01/74689 | A1 | 10/2001 |
| WO | WO 02/02418 | A1 | 1/2002 |
| WO | WO 02/18213 | A1 | 3/2002 |
| WO | WO 02/085755 | | 10/2002 |
| WO | WO 2004/028910 | A1 | 4/2004 |
| WO | WO 2004/106176 | A2 | 9/2004 |
| WO | WO 2004/106175 | A1 | 12/2004 |
| WO | WO 2005/012091 | A2 | 2/2005 |
| WO | WO 2005/025999 | A1 | 3/2005 |
| WO | WO 2005/087628 | A1 | 9/2005 |
| WO | WO 2006/113428 | A3 | 10/2006 |
| WO | WO 2007/047574 | A1 | 4/2007 |
| WO | WO 2007/127337 | A2 | 11/2007 |
| WO | WO 2010/058098 | A2 | 5/2010 |

OTHER PUBLICATIONS

International Search Report and Written Opinion for PCT/US2004/016405 dated Feb. 15, 2005.
IRRP for PCT/US2004/016405 dated Nov. 25, 2005.
Office Action for Application No. EP 06 750 165.0-2307 dated Nov. 24, 2008.
International Search Report for PCT/US2006/040361 dated Feb. 26, 2007.
IPRP (including Written Opinion) for PCT/US2006/040361 dated Apr. 16, 2008.
International Search Report and Written Opinion for PCT/US2007/006318 dated Sep. 11, 2007.
IRRP (including Written Opinion) for PCT/US2007/006318 dated Sep. 16, 2008.
International Search Report for PCT/US2006/014055 dated Aug. 24, 2006.
IPRP (including Written Opinion) PCT/US2006/014055 dated Oct. 16, 2007.
International Search Report for PCT/US2004/024581 dated Jul. 25, 2005.
IPRP (including Written Opinion) for PCT/US2004/024581 dated Jan. 30, 2006.
"Application and Development of PET Plastic Bottle," Publication of Tsinghad Tongfang Optical Disc Co. Ltd., Issue 4, 2000, p. 41. (No English language translation available).
International Search Report and Written Opinion dated Mar. 15, 2010 for PCT/US2010/020045.
Chanda, M. & Roy, Salil K., Plastics Technology Handbook, Fourth Edition, 2007, CRC Press, Taylor & Francis Group, pp. 2-24-2-37.
Official Notification for counterpart Japanese Application No. 2006-522084 dated May 19, 2009.
Examination Report for counterpart New Zealand Application No. 545528 dated Jul. 1, 2008.
Examination Report for counterpart New Zealand Application No. 569422 dated Jul. 1, 2008.
Examination Report for New Zealand Application No. 550336 dated Mar. 26, 2009.
Examination Report for counterpart New Zealand Application No. 545528 dated Sep. 20, 2007.
Examination Report for counterpart New Zealand Application No. 569422 dated Sep. 29, 2009.
Office Action for Chinese Application No. 2006800380748 dated Jul. 10, 2009.
Examiner's Report for Australian Application No. 2006236674 dated Sep. 18, 2009.
Examiner's Report for Australian Application No. 2006236674 dated Nov. 6, 2009.
Office Action for Chinese Application No. 200680012360.7 dated Jul. 10, 2009.
Examination Report for New Zealand Application No. 563134 dated Aug. 3, 2009.
Office Action for European Application No. 07752979.0-2307 dated Aug. 21, 2009.
International Search Report for PCT/US2006/014055 dated Dec. 7, 2006.
International Search Report and Written Opinion dated Sep. 8, 2009 for PCT/US2009/051023.
Office Action dated Feb. 3, 2010 for Canadian Application No. 2,604,231.
Communication dated Mar. 9, 2010 for European Application No. 09 173 607.4 enclosing European search report and European search opinion dated Feb. 25, 2010.
European Search Report for EPA 10185697.9 dated Mar. 21, 2011.
International Search report dated Apr. 21, 2010 from corresponding PCT/US2009/066191 filed Dec. 1, 2009.
International Preliminary Report on Patentability and Written Opinion dated Jun. 14, 2011 for PCT/US2009/066191. 7 pages.
Office Action, Japanese Application No. 2008-506738 dated Aug. 23, 2011.
Extended European Search Report for EPA 10185697.9 dated Jul. 6, 2011.
Patent Abstracts of Japan, vol. 012, No. 464; Dec. 6, 1988.
Patent Abstracts of Japan, vol. 2002, No. 09, Sep. 4, 2002.
Patent Abstracts of Japan, vol. 015, No. 239, Jun. 20, 1991.
Examination Report dated Jul. 25, 2012, in New Zealand Patent Application No. 593486.
Taiwanese Office Action dated Jun. 10, 2012, Application No. 095113450.
Japanese First Notice of Reasons for Rejection dated Aug. 23, 2011, in Application No. 2008-506738.
Japanese Second Notice of Reasons for Rejection dated Jun. 11, 2012, in Application No. 2008-506738.
Office Action dated Aug. 14, 2012, in Japanese Patent Application No. 2008-535769.
Examiner's Report dated Feb. 15, 2011 in Australian Application No. AU200630483.
Office Action dated Oct. 31, 2011, in Australian Patent Application No. 2011203263.
Office Action dated Jul. 19, 2011, in Japanese Patent Application No. 2008-535769.
Office Action dated Dec. 6, 2011, in Japanese Patent Application No. 2008-535769.
International Search Report and Written Opinion for PCT/US2012/050251 dated Nov. 16, 2012.
International Search Report and Written Opinion for PCT/US2012/050256 dated Dec. 6, 2012.
Requisition dated Feb. 3, 2010 for Canadian Application No. 2,604,231.
Requisition dated Jan. 9, 2013 for Canadian Application No. 2,559,319.
Office Action dated Feb. 5, 2013, in Mexican Patent Application No. MX/a/2008/004703.
Office Action dated Jul. 26, 2010 for Canadian Application No. 2,527,001.
Australian Office Action dated Mar. 3, 2011 in Application No. 2010246525.
Australian Office Action dated Nov. 8, 2011, in Application No. 2011205106.
Examiner Report dated May 26, 2010, in Australian Application No. 2004261654.
Examiner Report dated Jul. 23, 2010, in Australian Application No. 2004261654.
Requisition dated May 25, 2010 for Canadian Application No. 2,534,266.
Communication dated Jun. 16, 2006, for European Application No. 04779595.0.
Final Official Notification dated Mar. 23, 2010 for Japanese Application No. 2006-522084.
International Search Report and Written Opinion dated Dec. 18, 2012, in PCT/US12/056330.

* cited by examiner

SECTION TAKEN
PERPENDICULAR TO EXTRUSION

SECTION TAKEN
HORIZONTAL TO CONTAINER
CENTRAL AXIS

PLASTIC CONTAINER WITH ANGULAR VACUUM PANEL AND METHOD OF SAME

The disclosed subject matter relates generally to the field of packaging bulk products such as chemicals or foods. More specifically, the disclosed subject matter relates to plastic containers and closures, vacuum panel configurations for plastic containers, and systems and methods for making and using the same.

The disclosed subject matter involves plastic containers having panel portions constructed and operative to accommodate internal pressures within the container due to elevated temperature processing, such as hot-filling, pasteurization, and/or retort processing. Plastic containers according to embodiments of the disclosed subject matter can also be constructed and operative to accommodate internal pressures within the filled container resulting from subjecting the filled plastic container to cooling or cool-down processing.

In one or more exemplary embodiments, a hot-fillable, blow-molded plastic container may include a base defining a lower label stop and having a solid bottom end that includes a bearing portion defining a standing surface upon which the container may be supported on a horizontal surface; and a generally cylindrical sidewall extending from the base and configured to support a wrap-around label, the sidewall including: an upper label straight at a top end of the sidewall, the upper label straight having a uniform height; a lower label straight at a bottom end of the sidewall, the lower label straight having a uniform height; a plurality of columns extending between the upper label straight and the lower label straight; and a plurality of vacuum panels, each vacuum panel being disposed between adjacent ones of the plurality of columns and having an upper section, a middle section, a lower section, a first hinge portion connecting the upper section and the middle section, and a second hinge portion connecting the middle section and the lower section. The container may further include a shoulder portion extending from the top end of the sidewall, the shoulder portion defining an upper label stop above the sidewall; and a neck portion extending from the shoulder portion to create an open end of the container, the neck portion having a diameter less than a diameter of the sidewall and being operative to receive a closure.

The shoulder portion of the container may include a recessed portion, the recessed portion extending circumferentially along an outer periphery of the shoulder portion.

The container sidewall may include an upper recessed portion, the upper recessed portion extending circumferentially along an outer periphery of the sidewall below the upper label straight. The container sidewall may also include a lower recessed portion, the lower recessed portion extending circumferentially along an outer periphery of the sidewall above the lower label straight.

The container may define a container central axis and be formed in an initial blow molded condition with the middle section of each vacuum panel extending in a direction substantially parallel to the container central axis, the upper section of each vacuum panel being inclined from the first hinge portion toward the container central axis, and the lower section of each vacuum panel being inclined from the second hinge portion toward the container central axis. The upper section may be inclined at an angle with respect to the container central axis, the angle being greater than zero degrees and less than 20 degrees. The lower section may also be inclined at an angle with respect to the container central axis, the angle being greater than zero degrees and less than 20 degrees.

Each container vacuum panel may operate to move to an inverted state in response to pressure variation within the container after the container has been hot-filled with a product and sealed with the closure, the pressure variation including an internal vacuum associated with cooling of the hot-filled and sealed container, the vacuum panel being constructed and operative to move radially inward toward the container central axis in response to the internal vacuum. Following the move to an inverted state, the middle section of each vacuum panel may extend in a direction substantially parallel to the container central axis, with the upper section of each vacuum panel being rotated at the first hinge portion and inclined away from the container central axis, and the lower section of each vacuum panel being rotated at the second hinge portion and inclined away from the container central axis.

Each vacuum panel may be recessed with respect to its adjacent columns such that the vacuum panel is located radially closer to the container central axis than are the adjacent columns.

The container sidewall may include a plurality of islands protruding from respective ones of the plurality of vacuum panels and configured to support a wrap-around or shrink label. Each island may extend vertically in a direction substantially parallel to the container central axis, and each island may extend radially further from the container central axis than does its respective vacuum panel. An exemplary island may have an upper portion, a middle portion adjacent to the upper portion, and a lower portion adjacent to the middle portion, where the container defines a container central axis, the island extends in a direction substantially parallel to the container central axis, and the upper portion and the lower portion extend radially further from the container central axis than does the middle portion. Alternatively, an exemplary island may be formed in a variety of different shapes suitable to support a container label.

In one or more exemplary embodiments, a method may include: providing a plastic container formed by forcing a gas into the container via an aperture in the container, the formed plastic container defining a container central axis and including: a base defining a lower label bumper and having a solid bottom end; a generally cylindrical sidewall extending from the base and configured to support a wrap-around label, the sidewall including: an upper label straight at a top end of the sidewall; a lower label straight at a bottom end of the sidewall; a plurality of columns extending vertically between the upper label straight and the lower label straight; and at least one elongate vacuum panel arranged vertically on the sidewall between adjacent ones of the plurality of columns, the at least one vacuum panel having an upper section, a middle section, a lower section, a first transition portion between the upper section and the middle section, and a second transition portion between the middle section and the lower section. The container may further include a dome extending from the top end of the sidewall and defining an upper label stop above the sidewall; and a finish extending from the dome to create an open end of the container and operative to receive a closure. The method may further include hot-filling the plastic container via the finish with a product; sealing the hot-filled plastic container with the closure; cooling the hot-filled and sealed plastic container; and compensating for an internal pressure vacuum after cooling the plastic container.

In accordance with the method, the compensating for an internal pressure vacuum may include the at least one vacuum panel moving radially inward toward the container central axis in response to the internal vacuum. The vacuum panel middle section may move with respect to the upper section and the lower section from a radially outward position to a radially inward position. As the middle section moves from a radially outward position to a radially inward position, the upper section may rotate about the first transition portion through an angle, the angle being greater than 0 degrees and less than 40 degrees. An exemplary angle of rotation may be 5.0 degrees. As the middle section moves from a radially outward position to a radially inward position, the lower section may also rotate about the second transition portion through an angle, the angle being greater than 0 degrees and less than 40 degrees. An exemplary angle of rotation may be 5.0 degrees.

In accordance with the method, the compensating for an internal pressure vacuum may be performed without any movement within the base of the container.

In accordance with the method, the compensating for an internal pressure vacuum may include each of the at least one vacuum panel reducing a portion of the internal pressure vacuum to alleviate substantially the entire internal vacuum.

In one or more exemplary embodiments, a sidewall portion may be constructed and operative to accommodate a vacuum in a filled and sealed container and may include: a plurality of columns extending vertically between an upper end of the sidewall portion and a lower end of the sidewall portion; and a plurality of angular vacuum panels, each vacuum panel being disposed in a vertical orientation between adjacent ones of the plurality of columns and including an upper section, a middle section, and a lower section disposed in angular relation to each other, a first hinge connecting the upper section and the middle section, and a second hinge connecting the middle section and the lower section, the vacuum panels being constructed and operative to move radially inward toward a central axis defined by the container so that the vacuum in the filled and sealed container can be accommodated, where when the vacuum moves radially inward toward the central axis, the middle section may maintain a substantially parallel orientation with respect to the central axis. That is, the vacuum panel middle section may maintain a vertical orientation—as seen in a vertical section—that is substantially parallel with respect to the central axis. As the vacuum moves radially inward toward the central axis, the upper section may rotate about the first hinge and incline away from the container central axis, and the lower section may rotate about the second hinge and incline away from the container central axis. The upper section, the middle section, and the lower section may each be formed with a substantially linear vertical profile, as can be seen in a vertical section.

BRIEF DESCRIPTION OF THE DRAWINGS

The accompanying drawings are incorporated in and constitute a part of the specification.

DETAILED DESCRIPTION

Figure 1:
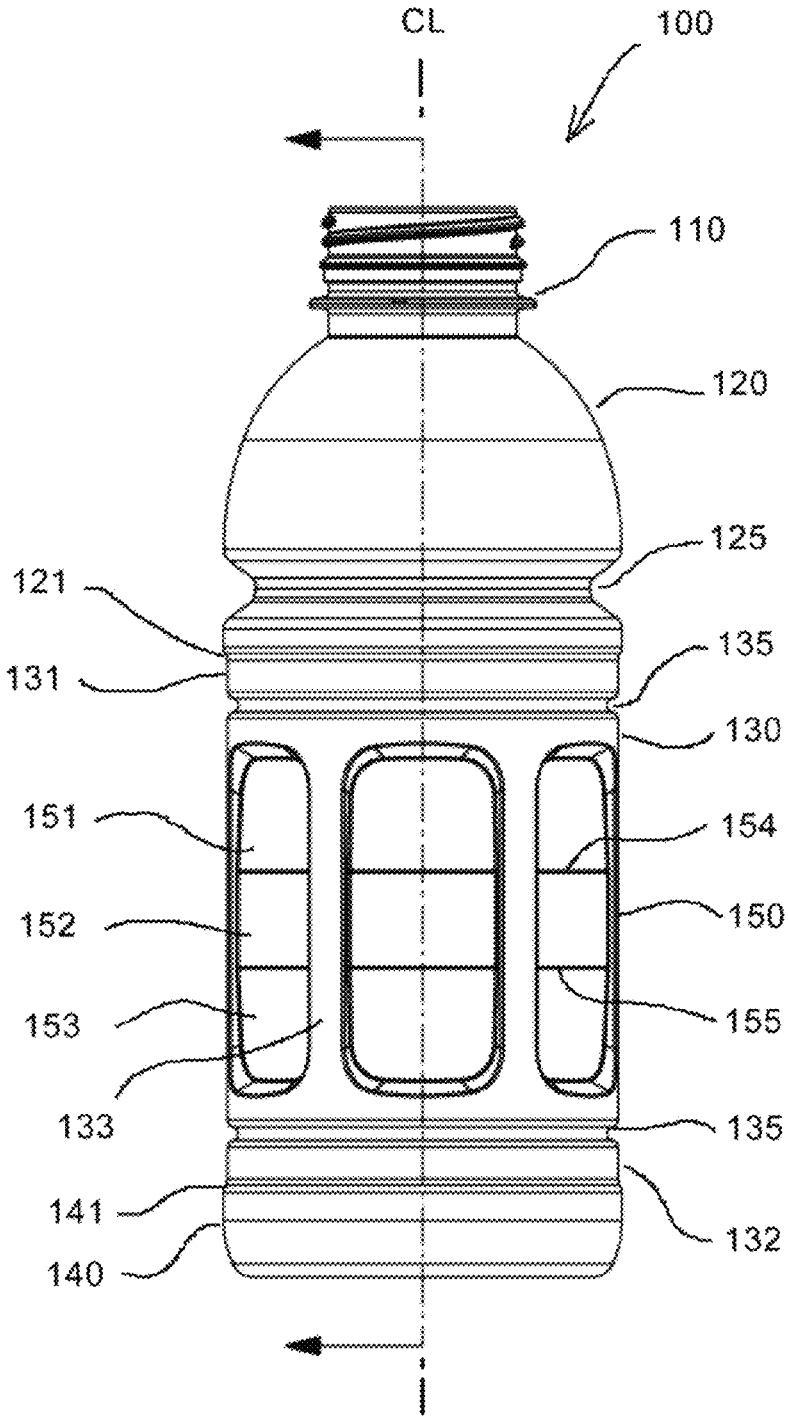
FIG. 1 is a front view of a container according to various embodiments of the disclosed subject matter.

While the exemplary embodiments illustrated herein may show various features of the disclosed subject matter, it will be understood that the features disclosed herein may be combined variously to achieve the objectives of the present embodiments.

The disclosed subject matter involves plastic containers, sidewall configurations for plastic containers, and systems, methods, and molds thereof. More particularly, the disclosed subject matter involves plastic containers having sidewall portions that are constructed and operative to accommodate elevated temperature processing, such as hot-filling, pasteurization, and/or retort processing. Plastic containers according to embodiments of the disclosed subject matter also may be configured and operative to accommodate internal forces caused by post elevated temperature processing, such as temperature-induced forces from varying temperatures in transit to or in storage at a distributor (e.g., wholesale or retail vendor) or end consumer, for example, prolonged effects of the weight of the product stored therein over time, etc., and/or cooling operations (including exposure to ambient temperature) after or between elevated temperature processing.

Generally speaking, in various embodiments, a sidewall portion of the container can move in response to internal pressures within the container that has been hot-filled and sealed, for instance. Optionally, the sidewall portion may be constructed and operative to move radially outward in response to internal pressures, such as headspace pressure and/or under the weight of the product, and also to move radially inward in response to a different internal pressure, such as an internal vacuum created within the container due to cooling or cooling processing of the container. Alternatively, the sidewall portion may be constructed and operative to resist movement in one direction, for example a radially outward direction in response to internal pressures (e.g., headspace pressure, product weight, etc.), but may be constructed and operative to move radially inward in response to a different internal pressure, such as an internal vacuum created within the container due to cooling or cooling processing of the container.

Sidewall portions of containers may have one or more movable vacuum panels that may assist or accommodate movement or flexure of the movable sidewall portion. The vacuum panel can be initially formed with three distinct sections that are generally oriented or arranged vertically with respect to a central axis of the container, with a middle section of the vacuum panel being oriented or arranged substantially directly vertically, and upper and lower sections of the vacuum panel being connected to and angling or sloping radially inward from respective upper and lower ends of the middle section, for instance. The three vacuum panel sections can be joined at two distinct junction areas where a change or transition in angular orientation with respect to the container central axis occurs, going from the substantially vertical middle section to the inwardly sloping upper section and the inwardly sloping lower section. The distinct junction or transition areas can act as hinges. The configuration of the three distinct vacuum panel sections combined with the two hinges facilitate activation of the vacuum panel at relatively lower internal vacuum pressures, and also serve to displace more volume and thus alleviate relatively greater internal vacuum, as compared with vacuum panels not having this configuration. When activated, the vacuum panel can move radially inward with the middle section maintaining a substantially vertical orientation with respect to the container central axis, and the upper and lower sections rotating about their respective hinged junctions with the upper and lower ends of the middle section. In an activated state, the upper and lower sections of the vacuum panel can, for instance, be angled or sloped radially outward from their respective upper and lower junctions or hinges at the upper and lower ends of the middle section.

Optionally, the vacuum panel can be initially formed with the middle section of the vacuum panel oriented or arranged substantially directly vertically with respect to the container central axis, and the upper and lower sections of the vacuum panel being connected to and angling or sloping radially outward from respective upper and lower ends of the middle section. In response to internal pressures, such as headspace pressure and/or under the weight of the product, the vacuum panel can move radially outward with the middle section maintaining a substantially vertical orientation with respect to the container central axis, and the upper and lower sections rotating about their respective hinged junctions with the upper and lower ends of the middle section. In this state, the upper and lower sections of the vacuum panel can, for instance, be angled or sloped radially inward from their respective upper and lower hinges at the upper and lower ends of the middle section. In response to a different internal pressure, such as an internal vacuum created within the container due to cooling or cooling processing of the container, the vacuum panel can move radially inward with the middle section maintaining a substantially vertical orientation with respect to the container central axis, and the upper and lower sections rotating about their respective hinges at the upper and lower ends of the middle section. In this activated state, the upper and lower sections of the vacuum panel can, for instance, be angled or sloped radially outward from their respective upper and lower hinges at the upper and lower ends of the middle section.

Plastic containers according to embodiments of the disclosed subject matter can be of any suitable configuration. For example, embodiments may include jars, such as wide-mouth jars, and base configurations thereof. Embodiments may also include single serve containers, bottles, jugs, asymmetrical containers, or the like, and sidewall configurations thereof. Thus, embodiments of the disclosed subject matter can be filled with and contain any suitable product including fluent, semi-fluent, or viscous food products, such as applesauce, spaghetti sauce, relishes, baby foods, brine, jelly, and the like, non-viscous products such as water, tea, juice, isotonic drinks or the like, or non-food products such as chemicals.

Plastic containers according to embodiments of the disclosed subject matter can be of any suitable size. For example, embodiments include containers with internal volumes of 8 oz., 20 oz., and 48 oz. Also, container sizes can include single-serving and multiple-serving size containers. Further, embodiments can also include containers with mouth diameters of 38 mm, 55 mm or higher, for instance.

Hot-fill processing can include filling a product into the container at any temperature in a range of at or about 130° F. to at or about 205° F. or in a range of at or about 185° F. to at or about 205° F. Optionally, the hot-fill temperature can be above 205° F. For example, a wide-mouth jar can be filled with a hot product at a temperature of at or about 205° F., such as 208° F. As another example, a single-serve container, such as for an isotonic or sports drink, can be filled with a hot product at a temperature of 185° F. or slightly below.

Plastic containers according to embodiments of the disclosed subject matter can be capped or sealed using any suitable closure, such as a plastic or metallic threaded cap or lid, a foil seal, a lug closure, a plastic or metallic snap-fit lid or cap, etc.

Plastic containers according to embodiments of the disclosed subject matter can also optionally be subjected to through processing, such as pasteurization and/or retort processing.

Pasteurization can involve heating a filled and sealed container and/or the product therein to any temperature in the range of at or about 200° F. to at or about 215° F. or at or about 218° F. for any time period at or about five minutes to at or about forty minutes, for instance. In various embodiments, a hot rain spray may be used to heat the container and its contents.

Retort processing for food products, for instance, can involve heating a filled and sealed container and/or the product therein to any temperature in the range of at or about 230° F. to at or about 270° F. for any time period at or about twenty minutes to at or about forty minutes, for instance. Overpressure also may be applied to the container by any suitable means, such as a pressure chamber.

Turning to FIG. 1, a front view of container 100 is shown according to various embodiments. Container 100 can comprise any suitable material. For example, container 100 can comprise one or more plastics or combinations thereof, the plastics including, but not limited to, polyethylene terephthalate (PET), low density polyethylene (LDPE), high density polyethylene (HDPE), and nylons, as well as other polyesters, polyolefins, and polycarboxyamides having suitable properties for the intended application. Container 100 can be made by any suitable process or method, including, but not limited to blow molding, injection molding, and extrusion blow molding. Container 100 is shown in FIG. 1 in its empty condition, after being initially formed, for example, by blow molding but before hot-filling and sealing with a closure, and in the absence of any internal or external applied forces.

Container 100 can be configured and operative to undergo elevated temperature processing, such as hot-filling, pasteurization, and/or retort processing. For example, container 100 may receive a food product as described herein at an elevated temperature as described herein, such as at a temperature from 185° F. to 205° F. Container 100 also can be constructed and operative to undergo cooling processing or cool-down operations. Container 100 is further constructed and operative to accommodate or react in a certain manner to any of the aforementioned forces or pressures. Container 100 also may be subjected to forces caused by post hot-fill and cooling operations, such as temperature-induced forces from varying temperatures in transit to or in storage at a distributor (e.g., wholesale or retail vendor) or end consumer, prolonged effects of the weight of the product stored therein over time, etc.

Figure 2:
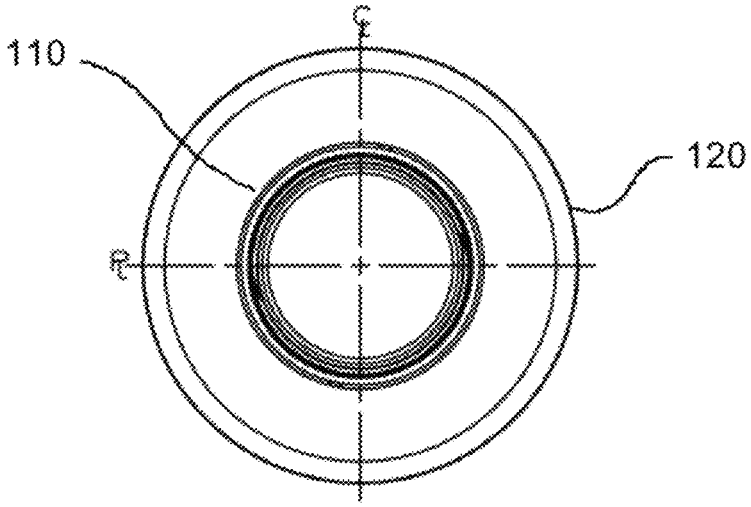
FIG. 2 is a top view of a container according to various embodiments of the disclosed subject matter.
Figure 3:
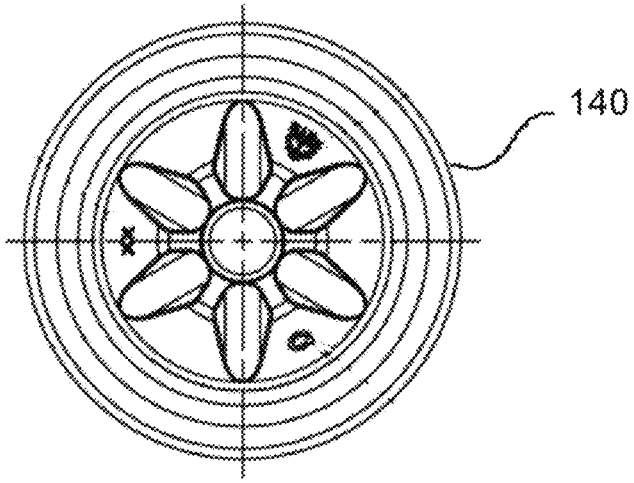
FIG. 3 is a bottom view of a container according to various embodiments of the disclosed subject matter.

As shown in FIGS. 1-3, an embodiment of container 100 includes a tubular or cylindrical sidewall 130, a threaded neck or finish 110 that forms an open end of container 100 and is operative to receive a threaded closure (e.g., a lid), a shoulder or dome 120 that extends from an upper portion of sidewall 130, and a base 140 attached to a lower portion of sidewall 130. Threaded finish 110 extends from an upper portion of shoulder or dome 120, can be a narrow-mouth finish or a wide-mouth finish, and may be of any suitable dimension. Alternatively, finish 110 may not be threaded, and another form of a closure may be implemented. Container 100 forms a container central axis CL that is substantially parallel to sidewall 130 and passes through the geometric center of container 100.

Container 100 also may have upper and lower label bumpers or stops 121, 141 located, respectively, at a lower end of shoulder 120 and at an upper end of base 140. Label stops 121, 141 may define a label area between which a label, such as a wrap-around label or a shrink label, can be affixed to sidewall 130. Sidewall 130 may include upper and lower label straights 131, 132 located, respectively, at upper and lower ends of sidewall 130. Label straights 131, 132 may comprise a radially outermost portion of sidewall 130 and may be of uniform height, e.g., 5-6 millimeters (mm). Label straights 131, 132 may be provided to support a label that can be affixed to sidewall 130. Sidewall 130 may also include a plurality of columns 133 extending vertically between upper label straight 131 and lower label straight 132 and comprising a radially outermost portion of sidewall 130. Optionally, sidewall 130 may include a plurality of concentric ribs or rings 135, circumscribing the sidewall 130 horizontally. Ribs 135 may be recessed radially inward with respect to the container central axis and may be located below upper label straight 131 and above lower label straight 132, thus forming boundaries or terminal points for columns 133. Ribs 135 may be provided in order to reinforce the sidewall 130 and to resist or prevent paneling, denting, barreling, ovalization, and/or other unwanted deformation of the sidewall 130, for example, in response to elevated temperature and/or cooling processing. Optionally, shoulder 120 may include one or more concentric ribs or rings 125, circumscribing shoulder 120 horizontally and recessed radially inward with respect to the container central axis.

Container 100 may also include one or more vacuum panels 150 located in sidewall 130. The one or more vacuum panels 150 may take up all or a portion of an induced vacuum caused by cooling a filled and sealed container 100. Each vacuum panel 150 can be located between respective adjacent ones of the plurality of columns 133 and be recessed with respect to its adjacent columns 133 such that it is located radially closer to the container central axis than are the adjacent columns. Each vacuum panel 150 may include an upper section or region 151, a middle section or region 152, and a lower section or region 153, as well as a first transition or hinge portion 154 connecting upper section 151 and middle section 152, and a second transition or hinge portion 155 connecting middle section 152 and lower section 153. Upper section 151, middle section 152, and lower section 153 may each be formed with a substantially linear or planar vertical profile, e.g., as seen in a vertical section. Additionally, upper section 151, middle section 152, and lower section 153 may each be formed with a curved horizontal profile, e.g., as seen in a horizontal section. Upper section 151, middle section 152, and lower section 153 may each be formed with the same linear length, or with different linear lengths.

Optionally, vacuum panel 150 may be defined as a composite vacuum panel formed of three separate vacuum panels—e.g., an upper panel, middle panel, and lower panel—joined by two connecting hinges; a first hinge between the upper panel and middle panel, and a second hinge between the middle panel and lower panel.

Figures 4A, 4B:
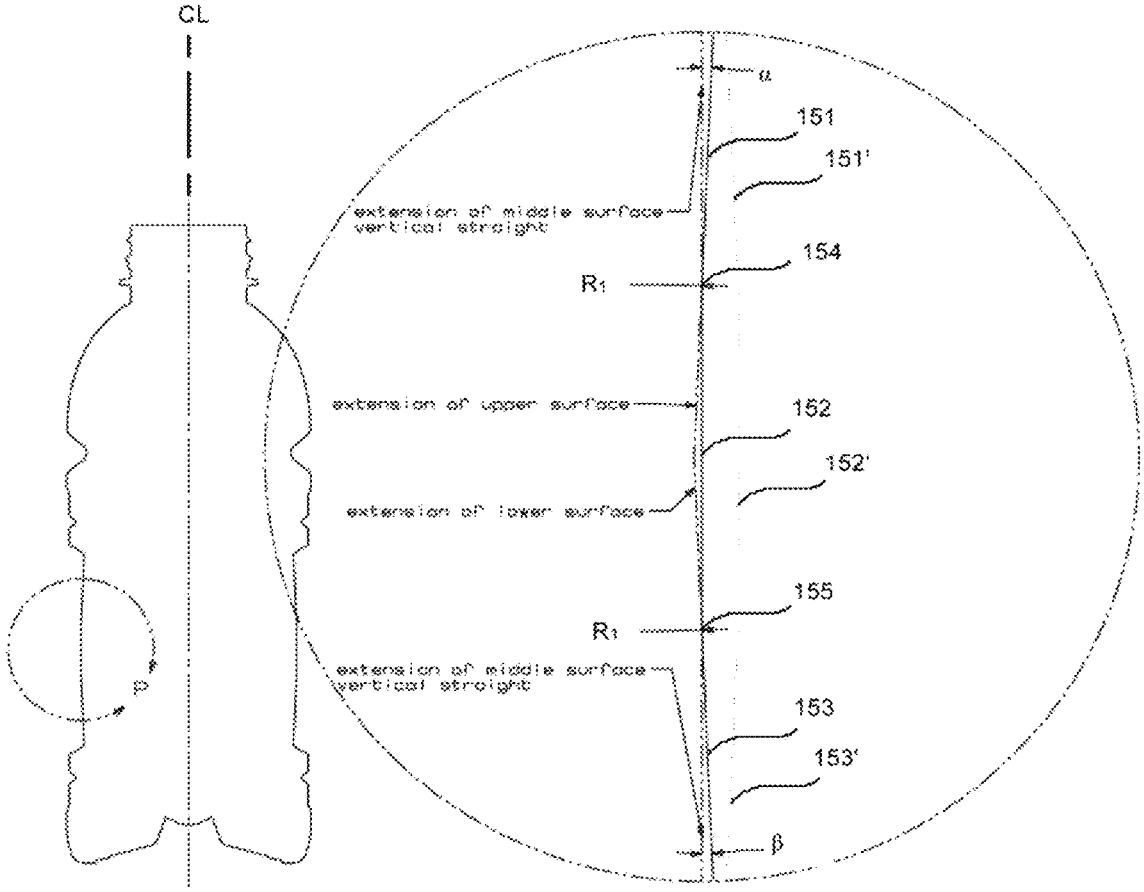
FIG. 4A is a cross-sectional view, taken along a container central axis of the container of FIG. 1.
FIG. 4B is a detail view of a sidewall portion of the container of FIG. 4A.

As is shown in FIGS. 4A and 4B, container 100 can be initially formed—e.g., in an initial blow-molded condition—with middle section 152 of vacuum panel 150 extending in a direction substantially parallel to the container central axis, upper section 151 being inclined from first hinge portion 154 toward the container central axis, and lower section 153 being inclined from second hinge portion 155 toward the container central axis. Optionally, container 100 can be initially formed with middle section 152 of vacuum panel 150 extending in a direction that is angled or tilted with respect to the container central axis, upper section 151 being inclined from first hinge portion 154 toward the container central axis, and lower section 153 being inclined from second hinge portion 155 toward the container central axis. Upper section 151 may be inclined from first hinge portion 154 toward the container central axis by an angle $\alpha$. Lower section 153 may be inclined from second hinge portion 155 toward the container central axis by an angle $\beta$. Angle $\alpha$ may measure between 0 and 20 degrees in magnitude. Angle $\beta$ may also measure between 0 and 20 degrees. Angles $\alpha$ and $\beta$ may have the same magnitude or different magnitudes. For instance, one or both of angles $\alpha$ and $\beta$ may be 2.5 degrees in magnitude. As shown in FIGS. 4A and 4B, middle section 152 is formed at a greater depth, or radial distance from the container central axis, than upper section 151 and lower section 153.

Figure 5:
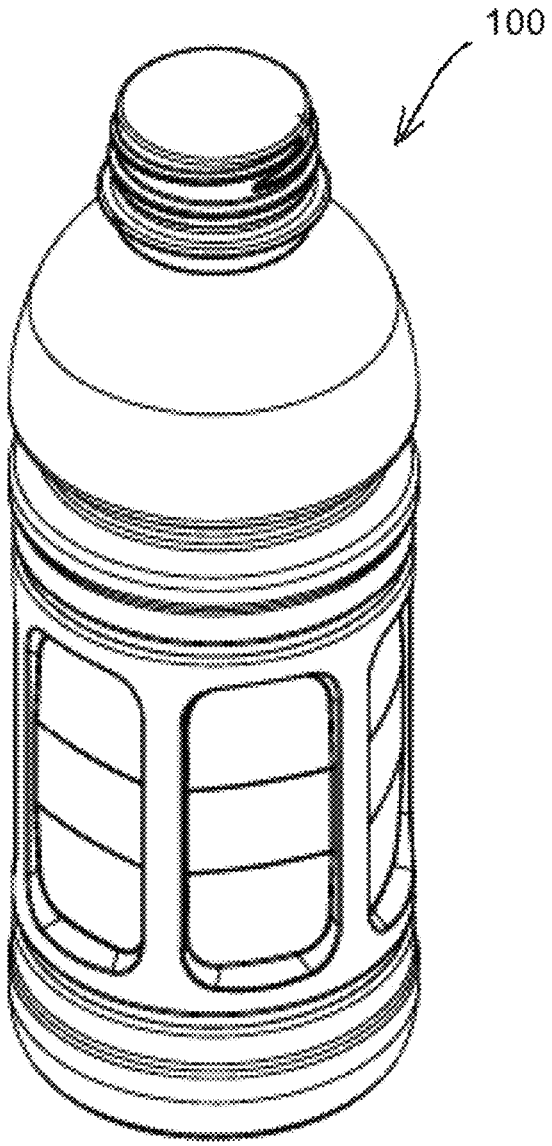
FIG. 5 is a front perspective view of the container shown in FIG. 1.

FIG. 5 shows a front perspective view of container 100 shown in FIG. 1.

Figure 6A:
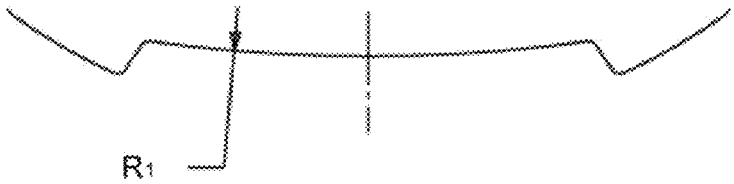
FIG. 6A is a fragmentary cross-sectional view depicting an enlarged portion of a container sidewall area shown in FIG. 4B.
Figure 6B:
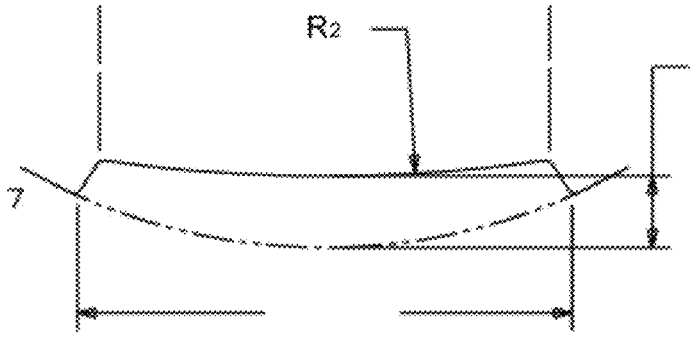
FIG. 6B is a fragmentary cross-sectional view depicting an enlarged portion of a container sidewall area shown in FIG. 4B.

In the case where sidewall 130 is substantially cylindrical in cross section, upper section 151, middle section 152, and lower section 153 may have the same radius $R_1$ when measured in cross-sections taken normal or perpendicular to the respective surfaces of upper, middle, and lower sections 151, 152, 153, i.e., perpendicular to the extruded sections or extrusions. This is shown, for example, in FIG. 6A. If the cross-sections of sidewall 130 are taken horizontally with respect to the container central axis, upper and lower sections 151, 153 may have a different radius $R_2$ than middle section 152, since upper and lower sections 151, 153 are tilted radially inward with respect to middle section 152 and the container central axis. This is shown, for example, in FIG. 6B.

An exemplary container may have six vacuum panels such as vacuum panel 150, equally spaced around the container sidewall, but the number of vacuum panels as well as the configuration, size and position of each vacuum panel may be adjusted accommodate variations in container size and shape.

Vacuum panel 150 is operative to move to an inverted state in response to pressure variation within container 100 after the container has been hot-filled with a product and sealed with a closure. The pressure variation may include an internal vacuum associated with cooling of hot-filled and sealed container 100, with vacuum panel 150 being constructed and operative to move radially inward toward the container central axis in response to the internal vacuum. During activation of vacuum panel 150 in response to the internal vacuum, middle section 152 moves or displaces radially inward toward the container central axis while maintaining a substantially parallel orientation with respect to the container central axis. As middle section 152 moves radially inward, upper section 151 rotates about first hinge 154 away from the container central axis, and lower section 153 rotates about second hinge 155 away from the container central axis. Following the move to an inverted state, middle section 152 of vacuum panel 150 extends in a direction substantially parallel to the container central axis, with upper section 151 being rotated at first hinge 154 and inclined away from the container central axis, and lower section 153 being rotated at second hinge 155 and inclined away from the container central axis. This is illustrated in FIG. 4B, for example, by the dashed lines indicating activated or inverted vacuum panel upper, middle, and lower sections 151', 152', 153'

This exemplary configuration, shown for instance in FIGS. 4A and 4B, where substantially linear middle section 152 is initially formed in an outwardly disposed—or "waisted out"—position with respect to substantially linear upper and lower sections 151, 153 and is connected to upper and lower sections 151, 153 via first and second hinges 154, 155, allows for relatively greater volume displacement by vacuum panel 150 and activation of vacuum panel 150 at relatively lower internal vacuum pressure, when compared with a vacuum panel that is configured, for instance, as a continuously curved wall as seen in a vertical section.

The existence of internal vacuum pressure can contribute to a crushing type failure in containers that are stacked vertically for transport and/or storage. Alleviating all or part of the internal vacuum pressure can result in a greater top load that can be withstood by filled and sealed containers. The features of vacuum panel 150 discussed previously, may increase the ability of container 100 to support higher vertical top loads and maintain its structural integrity during container stacking operations, as well as under the previously described transport and storage conditions.

Figure 7:
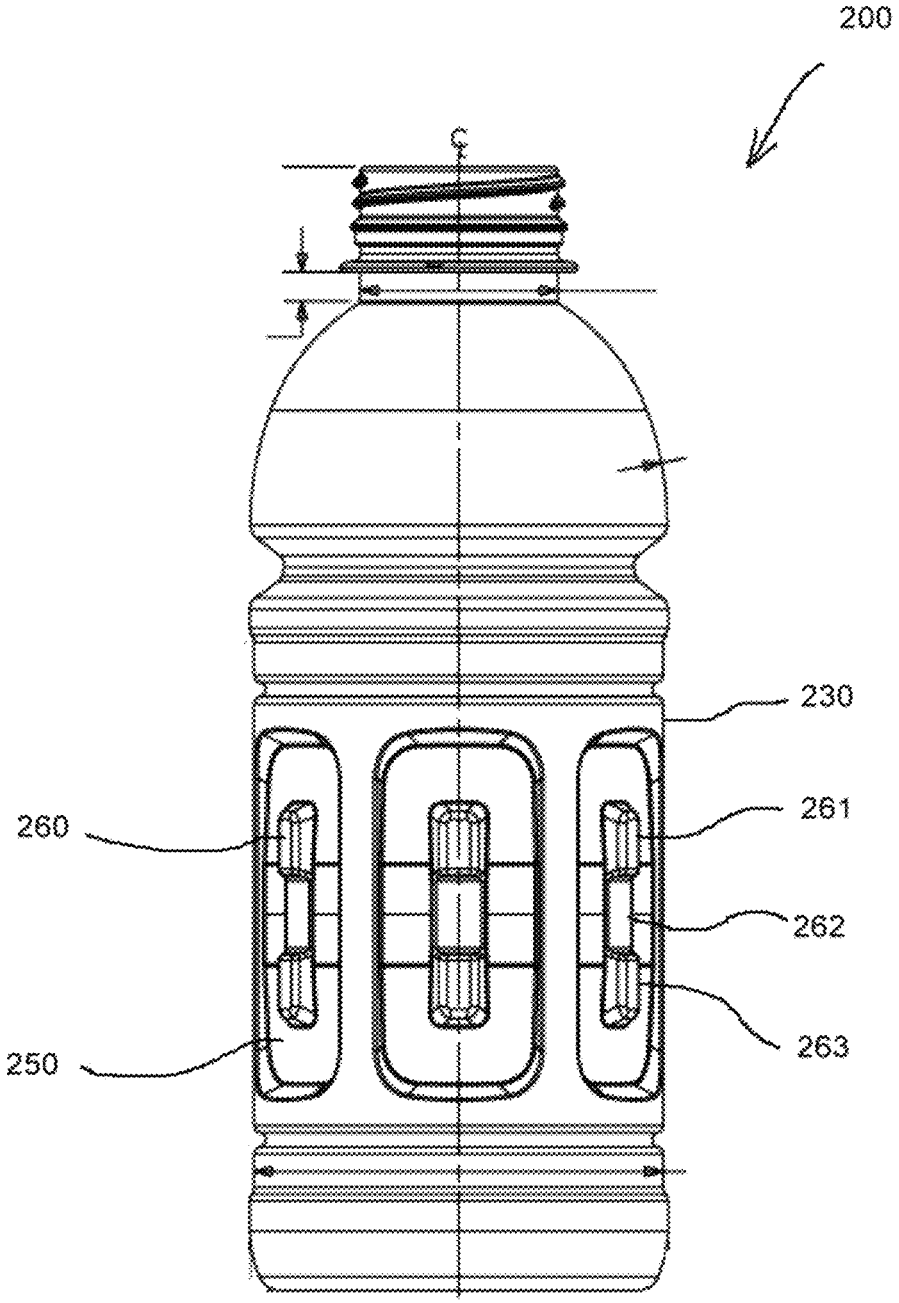
FIG. 7 is a front view of a container according to various embodiments of the disclosed subject matter.
Figure 8:
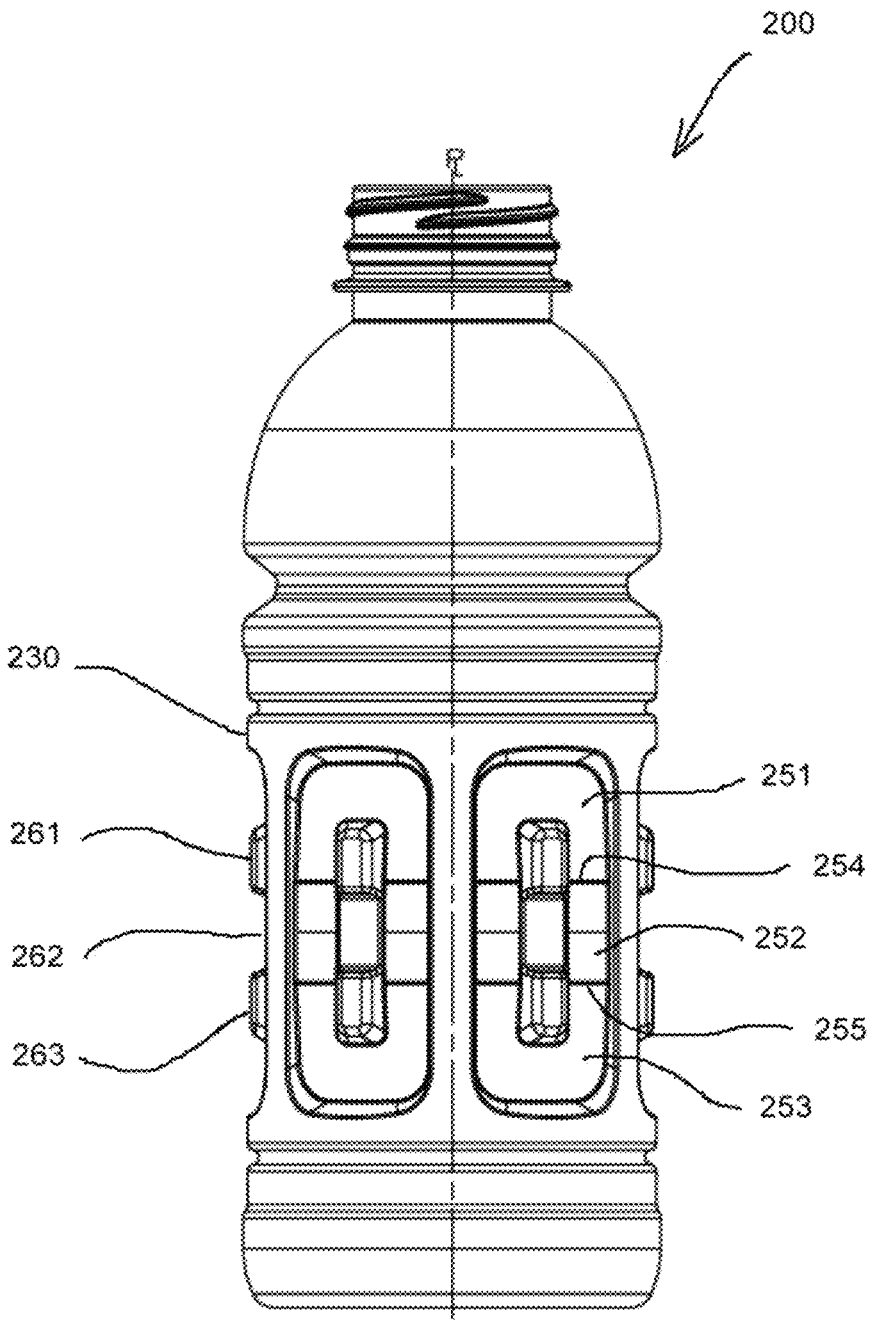
FIG. 8 is a side view of the container shown in FIG. 7.
Figure 9:
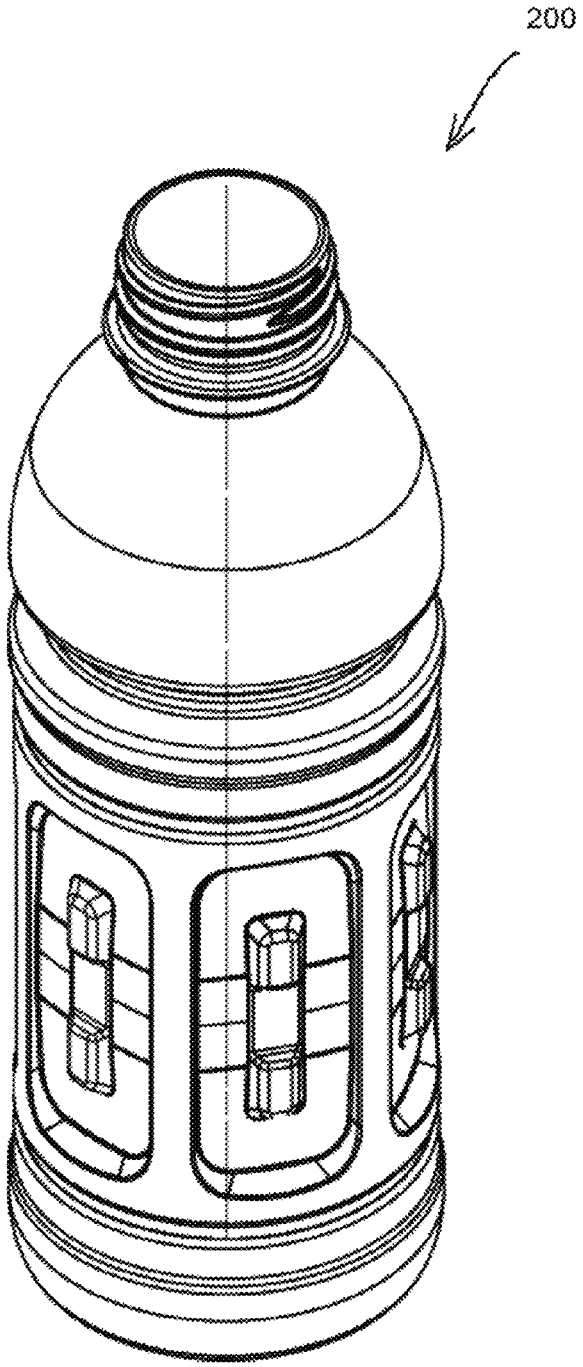
FIG. 9 is a front perspective view of the container shown in FIG. 7.

FIGS. 7-10 show a container 200 according to various embodiments. Container 200 can be similar to container 100, but can additionally include one or more islands 260 located on respective vacuum panels 250. Each island 260 can protrude from a respective vacuum panel 250 and can be configured to support a label, such as a wrap-around label or a shrink label, which can be affixed to sidewall 230. An exemplary island such as island 260 may have an upper portion 261, a middle portion 262 adjacent to upper portion 261, and a lower portion 263 adjacent to middle portion 262. Container 200 can define a container central axis CL, and island 260 can extend in a direction substantially parallel to the container central axis, with upper portion 261 and lower portion 263 extending radially further from the container central axis than middle portion 262. As can be seen in FIG. 8, upper portion 261 and lower portion 263 of island 260 can extend a radial distance from the container central axis that is substantially equal to the radially outermost portion of sidewall 230. Optionally, island 260 may be formed in a variety of shapes and sizes suitable to support a container label.

As shown, for example, in FIG. 8, container 200 can have vacuum panel geometry or configuration that is similar to that discussed previously with reference to FIGS. 4A and 4B. This exemplary configuration, where substantially linear or planar middle section 252 is initially formed in an outwardly disposed—or "waisted out"—position with respect to substantially linear or planar upper and lower sections 251, 253 and is connected to upper and lower sections 251, 253 via first and second hinges 254, 255, allows for relatively greater volume displacement by vacuum panel 250 and activation of vacuum panel 250 at relatively lower internal vacuum pressure, when compared with a vacuum panel that is configured, for instance, as a continuously curved wall as seen in a vertical section or profile. As an example, in a case where two plastic containers of substantially the same configuration—except for the first container having the previously described "waisted out" vacuum panel geometry and the second container having a vacuum panel that is configured as a continuously curved wall as seen in a vertical profile—are hot-filled, sealed, and cooled such that an internal pressure vacuum is induced, the first container may effect a volume displacement that is approximately 18% greater than that displaced by the second container, and may displace this volume at an internal vacuum pressure that is approximately 9% lower than that of the second container.

Figure 10:
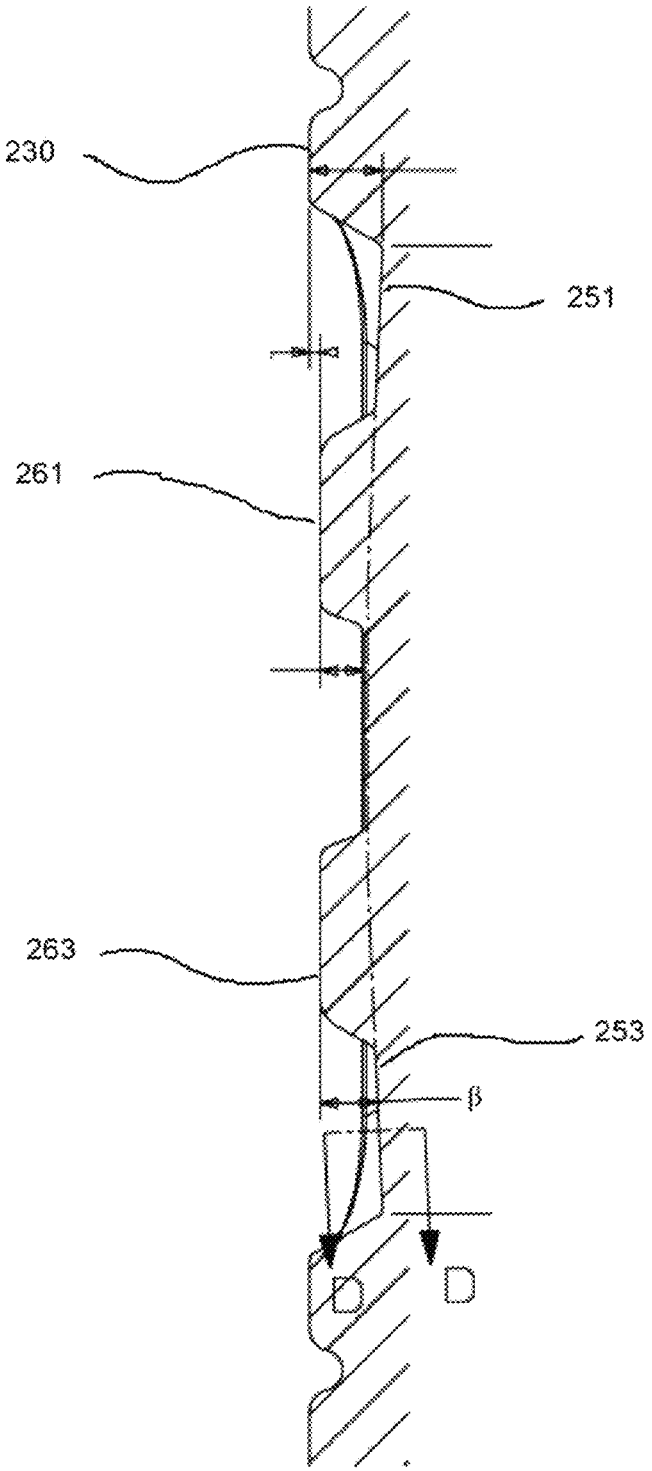
FIG. 10 is a fragmentary cross-sectional view depicting an enlarged portion of a container sidewall area shown in FIG. 7.

FIG. 10 shows a fragmentary cross-sectional view or profile of an enlarged sidewall portion of container 200 taken along the container central axis shown in FIG. 7.

Figure 11:
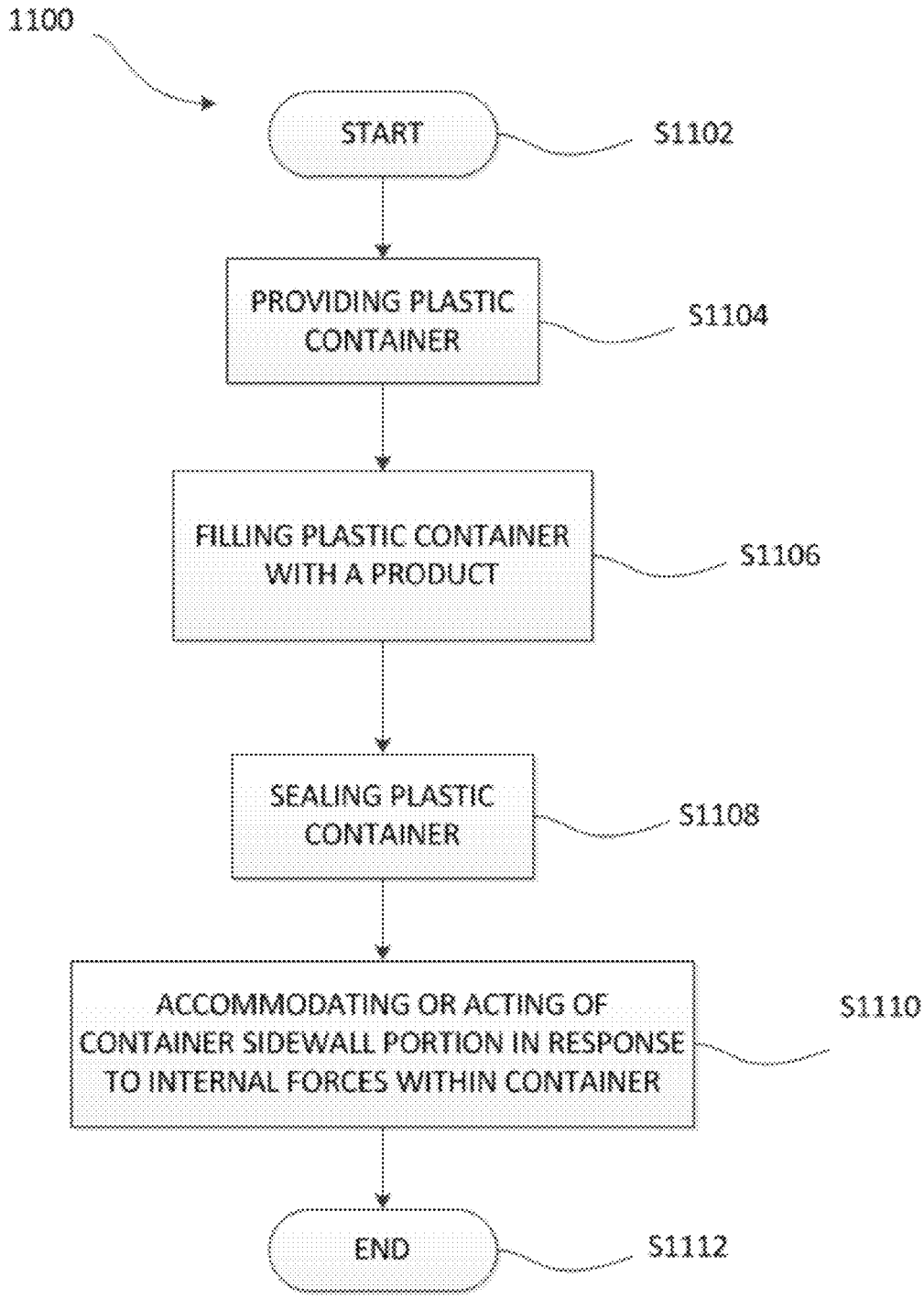
FIG. 11 is a flow chart of a method according to various embodiments of the disclosed subject matter.

FIG. 11 shows a flow chart for a method according to embodiments of the disclosed subject matter. Methods [1100] according to embodiments of the disclosed subject matter can begin [S1102] and may proceed to providing a plastic container as set forth herein [S1104]. Providing a plastic container can include blow molding or otherwise forming the container. Providing a plastic container also can include packaging, shipping, and/or delivery of a container. Methods can also include filling, for example, hot-filling the container with a product such as described herein, at a temperature as described herein [S1106]. After filling, the container can be sealed with a closure such as described herein [S1108]. After sealing filling and sealing the container, a sidewall portion of the container, such as one or more of vacuum panels 150, 250 described herein, can accommodate or act in response to an internal pressure or force in the filled and sealed container such as described herein [S1110]. As indicated above, internal pressure within the sealed and filled container can be caused by hot-filling the container, pasteurization processing to the container, retort processing to the container, or cooling processing to the container. The container sidewall portion can accommodate or act responsively as set forth herein based on the internal pressure or force and the particular configuration and construction of the sidewall portion as set forth herein. The method may then end [S1112].

Though containers in the form of bottles have been particularly shown in various figures, embodiments of the disclosed subject matter are not limited to bottles and can include plastic containers of any suitable shape or configuration and for any suitable use, including jars, jugs, asymmetrical containers, single-serve containers or the like. Also, embodiments of the disclosed subject matter shown in the drawings have circular cross-sectional shapes with reference to a central longitudinal axis. However, embodiments of the disclosed subject matter are not limited to containers having circular cross sections and thus container cross sections can be square, rectangular, oval, or asymmetrical.

Further, as indicated above, hot-filling below 185° F. (e.g., 180° F.) or above 205° F. is also embodied in aspects of the disclosed subject matter. Pasteurizing and/or retort temperatures above 185°, above 200° F., or above 205° F. (e.g., 215° F.) are also embodied in aspects of the disclosed subject matter.

Containers, as set forth according to embodiments of the disclosed subject matter, can be mode of a thermoplastic made in any suitable way, for example, blow molded (including injection) PET, PEN, or blends thereof. Optionally, containers according to embodiments of the disclosed subject matter can be multilayered, including a layer of gas barrier material, a layer of scrap material, and/or a polyester resin modified for ultra-violet ("UV") light protection or resistance.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, applicants intend to embrace all such alternatives, modifications, equivalents, and variations that are within the spirit and scope of the present invention.

What is claimed is:

1. A hot-fillable, blow-molded plastic container comprising:

a base defining a lower label stop and having a solid bottom end that includes a bearing portion defining a standing surface upon which the container may be supported on a horizontal surface;

a generally cylindrical sidewall extending from the base and configured to support a wrap-around label, the sidewall including:

an upper label straight at a top end of the sidewall, the upper label straight having a uniform height;

a lower label straight at a bottom end of the sidewall, the lower label straight having a uniform height;

a plurality of columns extending between the upper label straight and the lower label straight; and a plurality of vacuum panels, each vacuum panel disposed between adjacent ones of the plurality of columns and having an upper section, a middle section, a lower section, a first hinge portion connecting the upper section and the middle section, and a second hinge portion connecting the middle section and the lower section;

a shoulder portion extending from the top end of the sidewall, the shoulder portion defining an upper label stop above the sidewall; and a neck portion extending from the shoulder portion to create an open end of the container, the neck portion having a diameter less than a diameter of the sidewall and being operative to receive a closure, wherein the container defines a container central axis, and is formed in an initial blow molded condition with the middle section of each vacuum panel extending in a direction substantially parallel to the container central axis, the upper section of each vacuum panel being inclined from the first hinge portion toward the container central axis, and the lower section of each vacuum panel being inclined from the second hinge portion toward the container central axis, and further wherein at least one of the upper section or the lower section is inclined at an angle with respect to the container central axis, the angle being greater than 0 degrees and less than 20 degrees.

2. The container of claim 1, wherein the shoulder portion includes a recessed portion, the recessed portion extending circumferentially along an outer periphery of the shoulder portion.

3. The container of claim 1, wherein the sidewall includes an upper recessed portion, the upper recessed portion extending circumferentially along an outer periphery of the sidewall below the upper label straight.

4. The container of claim 1, wherein the sidewall includes a lower recessed portion, the lower recessed portion extending circumferentially along an outer periphery of the sidewall above the lower label straight.

5. The container of claim 1, wherein each vacuum panel is operative to move to an inverted state in response to pressure variation within the container after the container has been hot-filled with a product and sealed with the closure, the pressure variation including an internal vacuum associated with cooling of the hot-filled and sealed container, the vacuum panel being constructed and operative to move radially inward toward the container central axis in response to the internal vacuum.

6. The container of claim 5, wherein following the move to an inverted state, the middle section of each vacuum panel extends in a direction substantially parallel to the container central axis, the upper section of each vacuum panel being rotated at the first hinge portion and inclined away from the container central axis, the lower section of each vacuum panel being rotated at the second hinge portion and inclined away from the container central axis.

7. The container of claim 1, wherein each vacuum panel is recessed with respect to its adjacent columns such that the vacuum panel is located radially closer to the container central axis than are the adjacent columns.

8. The container of claim 1, the sidewall including a plurality of islands protruding from respective ones of the plurality of vacuum panels and configured to support the wrap-around label, wherein the container defines a container central axis, each island extends vertically in a direction substantially parallel to the container central axis, and each island extends radially further from the container central axis than does its respective vacuum panel.

9. A sidewall portion of a container constructed and operative to accommodate a vacuum in the container when filled and sealed, the sidewall portion comprising:

a plurality of columns extending vertically between an upper end of the sidewall portion and a lower end of the sidewall portion; and a plurality of angular vacuum panels, each vacuum panel disposed in a vertical orientation between adjacent ones of the plurality of columns and including an upper section, a middle section, and a lower section disposed in angular relation to each other, a first hinge connecting the upper section and the middle section, and a second hinge connecting the middle section and the lower section, wherein the container is formed in an initial blow molded condition with the middle section of each vacuum panel extending in a direction substantially parallel to a container central axis defined by the container, the upper section of each vacuum panel being inclined from the first hinge portion toward the container central axis, and the lower section of each vacuum panel being inclined from the second hinge portion toward the container central axis, and further wherein at least one of the upper section or the lower section is inclined at an angle with respect to the container central axis, the angle being greater than 0 degrees and less than 20 degrees, each vacuum panel being constructed and operative to move radially inward toward the container central axis to accommodate the vacuum in the container when filled and sealed, and wherein when each vacuum panel moves radially inward toward the container central axis, the middle section maintains a substantially parallel orientation with respect to the container central axis, the upper section rotates about the first hinge and inclines away from the container central axis, and the lower section rotates about the second hinge and inclines away from the container central axis.

10. The sidewall portion of claim 9, wherein the upper section, the middle section, and the lower section are each formed with a substantially linear vertical profile.

* * * * *